United States Patent [19]

Wachowicz et al.

[11] Patent Number: 4,923,008

[45] Date of Patent: May 8, 1990

[54] HYDRAULIC POWER SYSTEM AND METHOD

[75] Inventors: Stanley W. Wachowicz, Edmonton; R. James Downie, Sherwood Park, both of Canada

[73] Assignee: Baroid Technology, Inc., Houston, Tex.

[21] Appl. No.: 359,968

[22] Filed: Jun. 1, 1989

[30] Foreign Application Priority Data

Jan. 16, 1989 [CA] Canada ..... 588305

[51] Int. Cl.[5] ..... E21B 29/08; E21B 33/06; F16K 31/122; F17D 3/01

[52] U.S. Cl. ..... 166/250; 166/53; 166/55.1; 166/55.2; 137/14; 137/572

[58] Field of Search ..... 166/55, 297, 298; 137/14, 116.3, 116, 572, 596.14, 861; 251/1.1, 1.3

[56] References Cited

U.S. PATENT DOCUMENTS

| | | | |
|---|---|---|---|
| 3,044,481 | 7/1962 | Regan | 251/1.1 X |
| 3,338,302 | 8/1967 | Hubby | 166/363 X |
| 3,590,920 | 7/1971 | Orund et al. | 166/55 |
| 3,766,978 | 10/1973 | Orund et al. | 166/363 X |
| 3,804,175 | 4/1974 | Miller | 166/364 X |
| 3,993,100 | 11/1976 | Pollard et al. | 137/628 |
| 4,130,161 | 12/1978 | Jones | 166/363 X |
| 4,185,652 | 1/1980 | Zintz et al. | 137/81 |
| 4,240,503 | 12/1980 | Holt, Jr. et al. | 166/55 |
| 4,349,041 | 9/1982 | Bates | 137/1 |
| 4,413,642 | 11/1983 | Smith et al. | 137/14 |
| 4,467,833 | 8/1984 | Satterwhite et al. | 137/637 |
| 4,509,405 | 4/1985 | Bates | 91/420 |
| 4,724,866 | 2/1988 | Bates et al. | 137/498 |

OTHER PUBLICATIONS

SPE 15890, A. N. Vujasinovic & J. M. McMahan, "Deepwater Hydraulic BOP Control Systems", 8 pages, Oct. 20-22, 1986.

NL Industries, Inc. General Catalog 1984-85, "BOB Control Systems", pp. 5448-5454 and 5466-5475.

*Primary Examiner*—Stephen J. Novosad

*Attorney, Agent, or Firm*—Browning, Bushman, Anderson & Brookhart

[57] ABSTRACT

A hydraulic system and method are provided for supplying high pressure hydraulic fluid to a cylinder for operating a ram, e.g. a shearing and/or shut-off ram for a blowout preventer. It comprises means for supplying high pressure hydraulic fluid to the cylinder, said hydraulic fluid supply means comprising first and second storage means for storing hydraulic fluid under pressure, first conduit means for supplying hydraulic fluid under pressure from said first storage means to the cylinder, a pressure sensing device for determining the back pressure in said first conduit means, second conduit means for supplying hydraulic fluid under pressure from said second storage means to the cylinder and valve means for automatically opening said second conduit means when the back pressure in the first conduit means reaches a predetermined amount.

15 Claims, 2 Drawing Sheets

HYDRAULIC POWER SYSTEM AND METHOD

BACKGROUND OF THE INVENTION

1. Field of the Invention

This invention relates to a hydraulic power system and, more particularly, to a hydraulic power unit for actuating blowout preventers of the type having shearing and shut-off rams.

Blowout preventers form a regular part of well drilling equipment as used, for example, in the drilling of oil wells and gas wells. Two major classes of blowout preventers are currently utilized to shut off uncontrolled flow of pressurized fluids: ram-type blowout preventers and spherical blowout preventers. In the ram-type blowout preventer, a hydraulic cylinder having a rod attached to its piston is utilized to move a ram, which acts as the closure element to close the passage of the pressurized fluid.

2. Description of the Prior Art

A combination shearing and shut-off ram for a blowout preventer is described in U.S. Pat. No. 3,736,982, issued June 5, 1973. This system is used in instances where a drill string must be cut and/or sealed to prevent damage to the well and associated equipment. It is important that the drill pipe be cut quickly. In order to shear some heavy wall, large diameter drill pipes, high pressures must be maintained on the rams while the shear rams are closed up against the drill pipe. Without this, there is the danger of not being able to shear the pipe or of damaging the rams.

It is the object of the present invention to provide a simple system for maintaining a high hydraulic pressure through the entire shearing sequence of the blowout preventer.

SUMMARY OF THE INVENTION

The present invention relates to a hydraulic system for supplying high pressure hydraulic fluid to a cylinder for operating a ram, e.g. blowout preventer shearing and/or shut-off ram. It comprises means for supplying high pressure hydraulic fluid to the cylinder, which includes first and second storage means for storing hydraulic fluid under pressure, e.g. accumulator bottles, first conduit means for supplying hydraulic fluid under pressure from the first storage means to the cylinder, a pressure sensing device for determining the back pressure in the first conduit means, second conduit means for supplying hydraulic fluid under pressure from the second storage means to the cylinder and valve means for automatically opening the second conduit means when the back pressure in the first conduit means reaches a predetermined level.

The system is of particular interest for use with a hydraulically actuated pipe shearing device associated with a blowout preventer comprising a shearing blade, a hydraulically actuated cylinder operatively connected to the blade and means for supplying high pressure hydraulic fluid to the cylinder. It typically consists of two separate banks of accumulator bottles that are charged by a common pumping source, but are discharged separately. The banks of accumulator bottles are typically charged to about 3,000 psi. The first bank of accumulator bottles is then utilized for supplying fluid to stroke the rams closed and up against the drill pipe. As the rams begin to push up against the drill pipe, a back pressure is created and when this back pressure reaches in the order of about 800 psi, this causes a valve to automatically open permitting an immediate strong flow from the second bank of accumulator bottles. This means that as the blade is commencing its cut through the drill pipe, a fresh supply of hydraulic fluid is sent to the rams causing a rapid shearing of the pipe at full hydraulic pressure. While reference is made above to drill pipe, it will be understood that the invention applies to the shearing of elongated members generally extending down into a wellbore, e.g. pipes, tubes, sucker rods and wireline.

The two separate banks of accumulator bottles can be connected to the cylinder by various conduit configurations. Thus, totally separate conduits may be used, but preferably the second conduit connects into the first conduit. It is also preferable to provide a one way flow valve in the first conduit between the first bank of accumulator bottles and the connection to the second conduit and a one way flow valve in the second conduit.

According to another preferred embodiment, the two banks of accumulator bottles are connected by a conduit to permit simultaneous charging of the two banks. This conduit also preferably includes a one way flow valve which prevents flow in the direction from the second bank to the first bank of accumulator bottles.

Another embodiment of the invention relates to a method for supplying high pressure hydraulic fluid to a cylinder for operating a ram associated with a blowout preventer. It comprises supplying high pressure hydraulic fluid to a cylinder from first and second storage means for storing hydraulic fluid under pressure by means of first and second conduit means. The fluid is initially supplied to the cylinder from the first storage means through the first conduit means and a pressure sensing device senses back pressure in the first conduit. This generates a control signal when the back pressure reaches or exceeds a predetermined value, causing a valve to automatically open in the second conduit thereby providing an immediate strong flow of fluid from the second storage means to the cylinder.

BRIEF DESCRIPTION OF THE DRAWINGS

Certain preferred embodiments of the present invention are illustrated by the attached drawings in which.

DETAILED DESCRIPTION OF PREFERRED EMBODIMENTS

Figure 1:
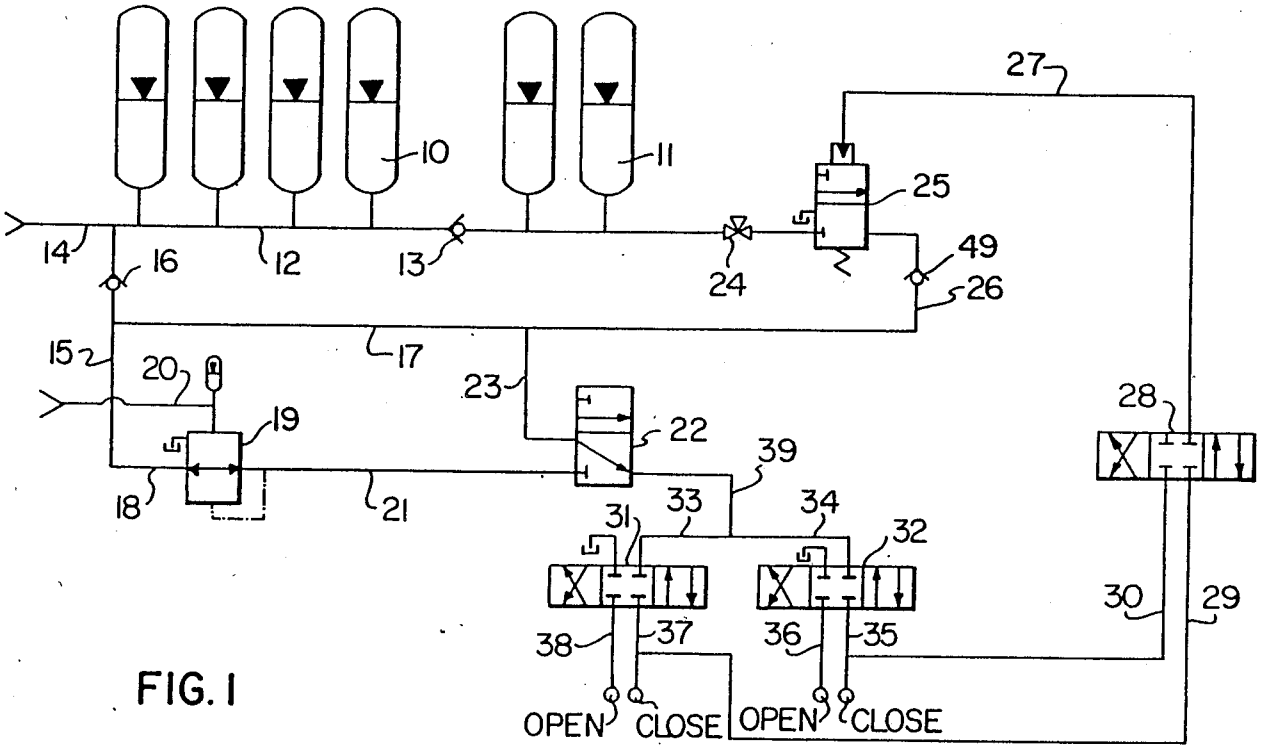
FIG. 1 is a schematic flow sheet of one embodiment of the hydraulic system of this invention.

The system as shown in FIG. 1 includes a first bank of accumulator bottles 10 and a second bank of accumulator bottles 11. Hydraulic fluid from supply line 14 is pumped into the bottles at a pressure of about 3,000 psi from line 14 and through line 12. A one way flow valve 13 is provided in line 12 between accumulator bottles 10 and 11 to prevent fluid flow in the direction between the second accumulator bottles 11 and the first accumulator bottles 10.

A branch line 15 extends from line 12 and it includes a one way flow valve 16 preventing flow toward line 12. A pair of further branch lines 17 and 18 extend off line 15. A branch line 23 extends off line 17 and this connects to bypass valve 22 shown in the flow position from line 23 in FIG. 1. Thus, the fluid flow comes down through line 23, through valve 22 and continues in line 39. From line 39 it travels via either branch line 33 to valve 31 or branch line 34 to valve 32.

These valves 31 and 32 are selectively individually used with valve 31 having outlets 37 and 38 connecting to the closed and open sides of the cylinder respectively and valve 32 having outlets 35 and 36 connecting the closed and open sides of the cylinder respectively. The lines 35 and 37 connect via lines 30 and 29 respectively to a selector valve 28. A single line 27 also connects at one end to valve 28 and at the other end to a hydraulic pilot operated control valve 25 which is actuated by a pressure build up in line 27. The pressure build up in line 27 is caused by a pressure build up in line 35 or 37 connecting to the cylinder. Valve 25 is typically a Koomey hydraulic pilot operated SPM control valve and is shown in the closed position in FIG. 1. When the back pressure builds up to a predetermined level, e.g. 800 psi, in line 35 or 37, valve 25 is automatically actuated so that it moves to the flow position permitting outflow from accumulator bottles 11 through valve 24, line 26 and then through line 23, valve 22, line 39 and valve 31 or 32. Line 26 preferably also includes a one way flow valve 49 preventing flow back toward bottles 11.

Line 18 connects to hydraulic regulator 19 which utilizes an external hydraulic pilot signal to set the regulated output pressure in line 21. Line 20 is the hydraulic pilot signal line which is set and maintained at a predetermined operating pressure either from a remote location or on the unit itself.

When fluid is supplied through lines 18 and 21, the rams are typically used as blind rams, e.g. for testing with no drill pipe in the hole. When fluid is passed through lines 17 and 23 and through valve 22, high pressure from line 15 bypasses the regulator 19 and thus, valve 22 is known as the bypass valve.

Figure 2:
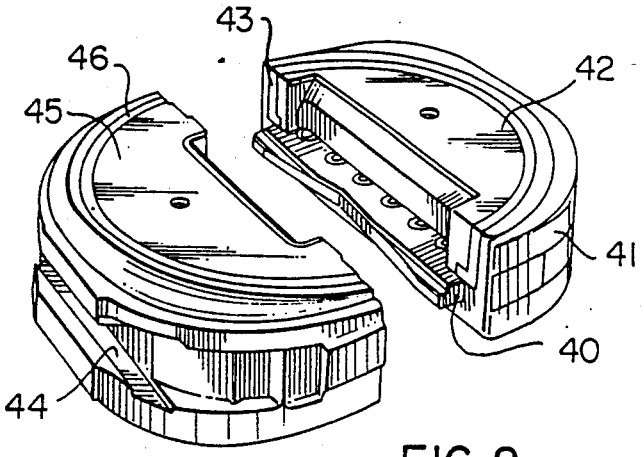
FIG. 2 is an isometric illustration of typical shear rams which utilizes the hydraulic system of FIG. 1.
Figure 3:
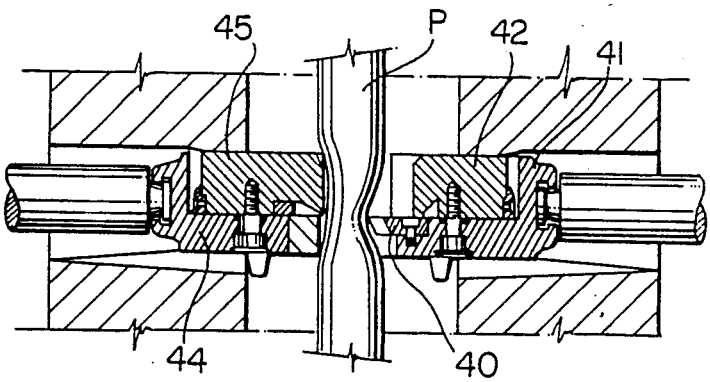
FIG. 3 is a schematic illustration of a pipe shearing system with the shear rams partially closed.
Figure 4:
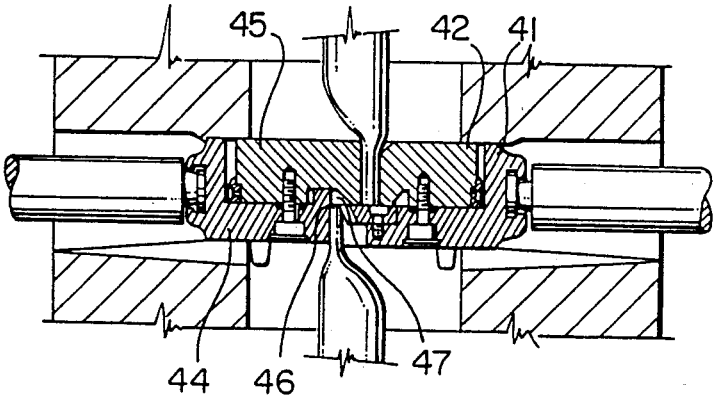
FIG. 4 is a schematic illustration of a pipe shearing system with the shear rams fully closed.

The shear rams are well known in the industry and will be described only briefly as shown in FIGS. 2-4. They include a lower holder 41 and an upper holder 44. The lower holder 41 includes a shear blade 40, a lower block member 42 and a lower rubber seal 43. The upper holder 44 includes an upper block 45 and an upper rubber seal 46.

The operation of the shear rams is shown in FIGS. 3 and 4, with FIG. 3 showing the rams closing and commencing to engage a pipe P. Thus, the shear blade 40 in FIG. 3 is commencing to compress the pipe P. The closing motion of the upper holder 44 pushes the horizontal seal 47 forward and downward on top of the shear blade, resulting in a tight sealing contact. The horizontal seal 47 has a molded-in support plate 46 which holds it in place when the rams are open.

While presently preferred embodiments of the invention are given for the purpose of disclosure, numerous changes in the details of construction and arrangement of parts will readily suggest themselves to those skilled in the art and which are encompassed within the spirit of the invention and the scope of the appended claims.

What is claimed is:

1. A hydraulic system for supplying high pressure hydraulic fluid to a cylinder for operating a shearing and/or shut-off ram for a blowout preventer, comprising means for supplying high pressure hydraulic fluid to the cylinder, said hydraulic fluid supply means comprising first and second storage means for storing hydraulic fluid under pressure, first conduit means for supplying hydraulic fluid under pressure from said first storage means to the cylinder, a pressure sensing device for determining the back pressure in said first conduit means, second conduit means for supplying hydraulic fluid under pressure from said second storage means to the cylinder and valve means for automatically opening said second conduit means when the back pressure in the first conduit means reaches a predetermined amount.

2. A system according to claim 1 wherein the first and second storage means comprise first and second banks of accumulator bottles.

3. A system according to claim 2 wherein said second conduit means connects to said first conduit means.

4. A system according to claim 1 which includes a third conduit means flow connecting the first and second storage means, said third conduit means including a one-way flow valve to prevent fluid flow in the direction from the second storage means to the first storage means.

5. A system according to claim 3 wherein said first and second conduit means each includes a one-way flow valve to prevent fluid flow in the direction of each storage means.

6. A system according to claim 2 wherein said valve means comprises a hydraulic pilot operated control valve.

7. A hydraulically actuated shearing device for shearing an elongated member extending downhole into the wellbore comprising a shearing blade, a hydraulically actuated cylinder operatively connected to the blade and means for supplying high pressure hydraulic fluid to the cylinder, said hydraulic fluid supply means comprising first and second storage means for storing hydraulic fluid under pressure, first conduit means for supplying hydraulic fluid under pressure from said first storage means to the cylinder, a pressure sensing device for determining the back pressure in said first conduit means, second conduit means for supplying hydraulic fluid under pressure from said second storage means to the cylinder and valve means for automatically opening said second conduit means when the back pressure in the first conduit means reaches a predetermined amount.

8. A device according to claim 7 wherein the first and second storage means comprise first and second banks of accumulator bottles.

9. A device according to claim 7 wherein said second conduit means connects to said first conduit means.

10. A device according to claim 7 wherein the valve means comprises a hydraulic pilot operated control valve.

11. A system according to claim 7 which includes a third conduit means flow connecting the first and second storage means, said third conduit means including a one-way flow valve to prevent fluid flow in the direction from the second storage means to the first storage means.

12. A system according to claim 9 wherein said first and second conduit means each includes a one-way flow valve to prevent fluid flow in the direction of each storage means.

13. A method for supplying high pressure hydraulic fluid to a cylinder for operating a shearing and/or shut-off ram for a blowout preventer, which comprises supplying the fluid from first and second high pressure hydraulic storage means by way of first and second conduit means, and including the steps of initially supplying fluid to the cylinder from the first storage means via the first conduit means until a back pressure develops in said first conduit means, sensing the back pressure by means of a pressure sensing device, generating a signal when the back pressure reaches or exceeds a predetermined value, said signal causing a valve to automatically open in the second conduit thereby providing a high pressure flow of fluid from the second storage means to the cylinder.

14. A method as defined in claim 13, further comprising the steps of interconnecting the first and second high pressure hydraulic storage means by way of third conduit means, and preventing fluid flow along the third conduit means in the direction from the second storage means to the first storage means.

15. A method as defined in claim 13, further including the steps of connecting the second conduit means to the first conduit means, and preventing fluid flow in both the first and second conduit means in the direction toward its respective storage means.

* * * * *